US005507872A

United States Patent [19]

Antenucci et al.

[11] Patent Number: 5,507,872

[45] Date of Patent: Apr. 16, 1996

[54] CONTACT SENSOR-BASED MICRODISPENSING TOOL

[75] Inventors: Annette B. Antenucci, Pittsburgh, Pa.; Michael Berger, Gardiner, N.Y.; Judy E. Lambert, Austin, Tex.; David T. Naugle, Poughkeepsie, N.Y.; Stephen A. Olson, San Jose, Calif.; Jae M. Park, Seoul, Rep. of Korea; Thomas Rednour, Beacon, N.Y.; Benoit Ventimiglia, Poughkeepsie, N.Y.; Richard J. Weckesser, Rhinebeck, N.Y.

[73] Assignee: International Business Machines Corporation, Armonk, N.Y.

[21] Appl. No.: 343,151

[22] Filed: Nov. 22, 1994

[51] Int. Cl.[6] ..... B05C 5/00

[52] U.S. Cl. ..... 118/712; 118/200; 118/300; 118/323; 118/410; 156/357; 156/578; 239/290; 239/424

[58] Field of Search ..... 118/200, 256, 118/300, 712, 323, 410, DIG. 2; 239/290, 423, 424; 427/96, 207.1; 156/357, 578

[56] References Cited

U.S. PATENT DOCUMENTS

| | | | |
|---|---|---|---|
| 2,510,274 | 6/1950 | Barry et al. | 118/243 |
| 3,810,779 | 5/1974 | Pickett et al. | 427/256 |
| 4,330,354 | 5/1982 | Deubner et al. | 118/712 |
| 4,569,305 | 2/1986 | Ferri et al. | 118/211 |
| 4,572,103 | 2/1986 | Engel | 118/410 |
| 4,597,526 | 7/1986 | Egli et al. | 239/290 |
| 4,661,368 | 4/1987 | Rohde et al. | 427/8 |
| 4,987,854 | 1/1991 | Hall | 118/300 |
| 5,119,759 | 6/1992 | Hicks | 118/712 |
| 5,186,982 | 2/1993 | Blette et al. | 427/96 |

*Primary Examiner*—Laura Collins
*Attorney, Agent, or Firm*—Ira D. Blecker

[57] ABSTRACT

A contact-based microdispensing tool for delivering extremely minute globules of epoxy material to repaired sites on high circuit density modules. The tool includes a solid probe integrally mounted in a contact sensor assembly incorporating an air-levitated core of a linear voltage differential transducer. The levitated core and the probe connected thereto are supported in neutral equilibrium by an air bearing assembly. As the assembly probe is brought into contact with one of the sites, the globule flows upon the site, the equilibrium is disturbed and a signal is produced by the transducer to halt movement of the probe relative to the site.

8 Claims, 2 Drawing Sheets

CONTACT SENSOR-BASED MICRODISPENSING TOOL

BACKGROUND OF THE INVENTION

The present invention generally relates to the depositing of small quantities of a liquid at a desired location, and more particularly, relates to a tool for dispensing extremely minute globules of liquid at a predetermined location.

Large scale, high density circuits on multilayer ceramic modules used in thermal conduction modules require engineering changes (EC) and repairs during bonding, assembly and testing. Such corrections involve the deletion of specified circuit lines and/or the rerouting of circuit lines, as is well understood in the art. The passivation of EC/repair sites is a relatively new requirement, brought about by the ever increasing number of chip input/output (I/O) terminals and the smaller chip pitches which together greatly exacerbate the crowding of the circuit components with consequent minimal clearance therebetween. Without passivation, the thermal cycling of the modules following completion of the repairs gives rise to the reflow of adjacent soldered connections and the bridging of respective components to establish unwanted circuit connections. Thus, it becomes necessary to passivate the required sites to prevent the formation of such spurious circuit pathways.

Passivation involves coating the repaired site with an insulation material which conveniently is in liquid form so that it might be applied in metered quantity and conform to the topography of the repaired site. Several approaches to the localized application of material are known in the art and variously employ hollow or solid probes carrying the material into contact with the desired location. U.S. Pat. No. 3,810,779, for example, issued on May 14, 1974, to C. G. Pickett, et al., utilizes a hollow probe which carries a droplet of liquid to a desired location on a surface. The movement of the probe is halted when the droplet contacts the surface. Deposition of liquid in the range of less than 0.3 milligrams is contemplated. U.S. Pat. No. 4,661,368, issued on Apr. 28, 1987, to Robert R. Rohde, et al., similarly employs a hollow probe but brings the probe itself into contact with the target surface in order to accurately establish a predetermined offset distance from the target surface for metered application thereto of dots of adhesive material.

U.S. Pat. No. 4,569,305, issued on Feb. 11, 1986, to Benjamino Ferri, et al., and U.S. Pat. No. 2,510,274, issued on Jun. 6, 1950, to J. F. Barry, et al., also bring a probe droplet of glue or paste into contact with a surface and the probe itself into surface contact, respectively, but utilize a solid probe, rather than the hollow probes of the aforementioned '779 and '368 patents. None of the patents cited deal with the problems associated with the delivery of metered amounts of material of such minute quantities as 2–3 mil diameter dots which correspond to a fraction of 1 nanoliter. Even micrometer-driven syringes are incapable of reproducibly delivering dots of material below about 6 mils in diameter at the present state of the art.

Passivation of repaired sites is but one application to which the present invention is directed. Passivation of repaired sites presents problems common to other applications where microdispensing of a liquid is desired. Other applications may include the microdispensing of, for example, epoxy, polyimide, fluxes, or adhesives, for various uses.

SUMMARY OF THE INVENTION

One object of the invention is to provide solid probe means for delivering extremely minute globules of liquid material to a surface.

Another object is to deliver extremely minute globules of liquid material by carrying said globules on a solid probe and bringing said probe into contact with a surface.

A further object is to provide a probe assembly for delivering extremely minute globules of material by sensing when said assembly is brought into contact with a surface.

An additional object is to place insulating material on 6 mil diameter repaired sites on high circuit density modules.

These and other objects of the present invention, as will appear from a reading of the following specification, are achieved in a best mode embodiment of the invention by the provision of a solid probe integrally mounted in a contact sensor assembly incorporating an air-levitated core of a linear voltage differential transducer. The levitated core and the probe connected thereto are supported by an air bearing assembly designed to minimize the contact pressure brought to bear by the probe on the substrate on which the liquid is dispensed, thereby protecting both the probe and the substrate.

The sensor assembly is designed to be fixed to a linear motion stage which lowers the assembly slowly until the probe touches the surface of the substrate on which the liquid is to be dispensed. The substrate, in turn, can be supported on a three axis stepper motor controlled table along with a reservoir of liquid material and a sponge station. During the repair cycle, the table can be positioned so that the probe is located over the reservoir of liquid. The table then can be raised to allow the probe to pick up the liquid material and be sequentially positioned to a desired site for deposition. The tip of the probe may be cleaned during one of the deposition cycles by dipping it in the sponge station located on the table (the sponge station contains a solvent for the liquid that is dispersed).

BEST MODE FOR CARRYING OUT THE INVENTION

As previously pointed out, many techniques are known in the prior art for metering out globules of liquid material and delivering same to predetermined locations on a substrate for various purposes, involving the use of hollow and solid probes and syringes. Some times the globule is transferred to the substrate by contact of only the globule to the substrate. At other times, the transfer is effected by contact of the probe itself to the substrate. Generally, all of the aforementioned techniques are adequate when the scale of the operations encountered is sufficiently large. As the scale is very significantly reduced, however, as in the case of making repairs and engineering changes requiring globules of the order of 30 microns, the known globule transfer mechanisms become inadequate.

The remainder of the discussion will focus on the deposition of epoxy to repaired sites for the purpose of passivation. It should be understood, however, that the invention is generally directed to the microdispensing of liquids, preferably on the order of 0.1 to 1 nanoliters in volume. Such liquids may include, for the purpose of illustration and not limitation, epoxy, polyimide, fluxes and adhesives.

Small globule size necessitates small probe size. Small probe size requires the avoidance of excessive contact pressure when the option of direct probe contact is chosen. Very slight contact pressure aggravates the problem of determining precisely when contact between probe and substrate has been made. The determination of only globule contact with a substrate is even more difficult a task than is the determination of direct probe contact. "Dead reckoning" positioning of a probe, in order to avoid actual contact sensing, is not viable on high circuit density substrates which usually are characterized by irregular topology.

Figure 1:
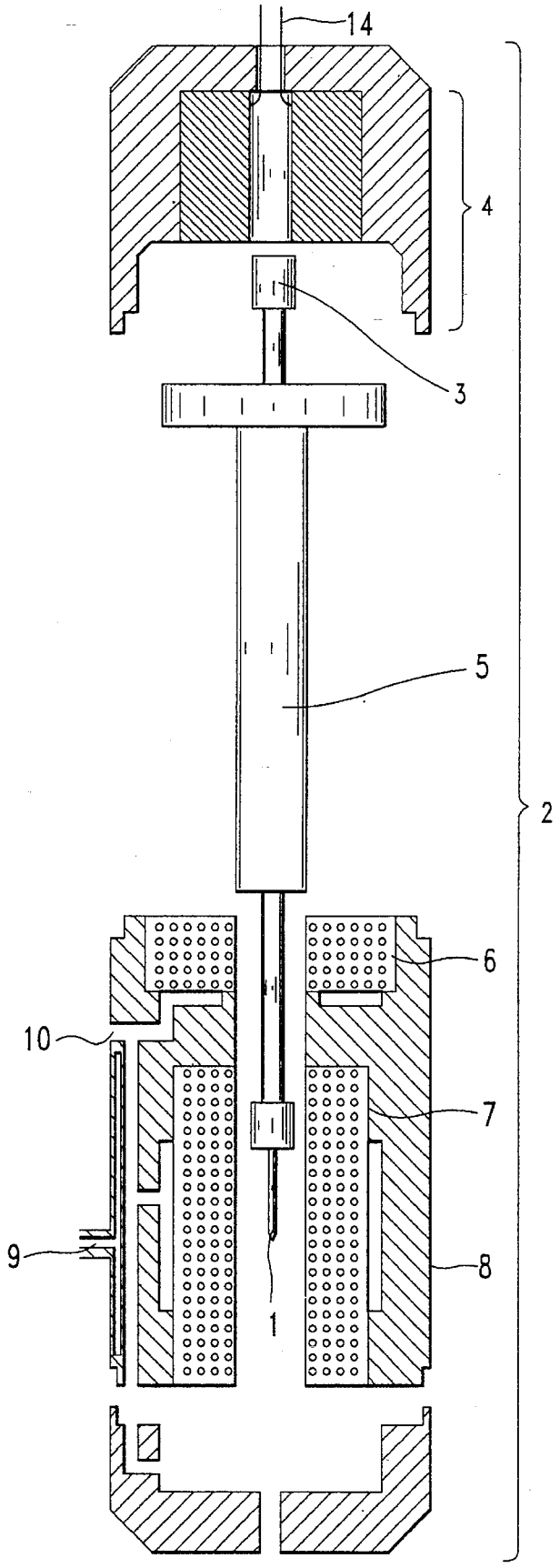
FIG. 1 is an exploded view of the best mode embodiment of the contact sensor assembly of the present invention.
Figure 2:
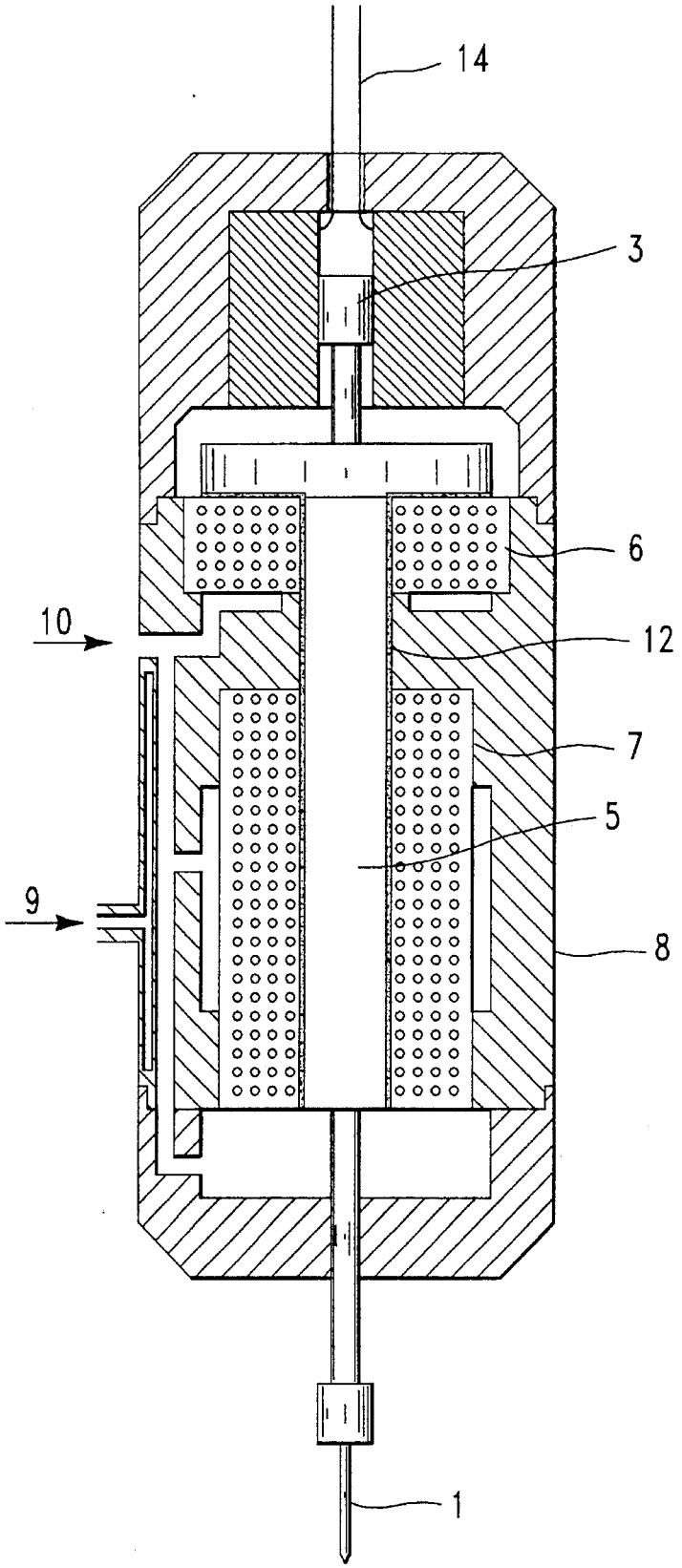
FIG. 2 is an assembled view of the structure of FIG. 1.

Accordingly, in accordance with the present invention, as shown in the exploded view of FIG. 1, solid probe 1 is integrally mounted in direct contact probe sensor assembly 2. The probe 1 is fixed via member 5 to the air levitated core 3 of linear voltage differential transducer 4 which probe and core are moved by the very small force of contact. Wires 14 from a suitable power source (not shown) provide power to the linear voltage differential transducer 4. The plunger comprising probe 1, member 5 and core 3 is free to move along a vertical axis centrally within upper porous carbon air distributor 6 and lower porous carbon air distributor 7 substantially free of friction. The central housing member 8 is equipped with air supply inlet 9 and an air vent 10. The porous carbon air distributors 6 and 7 help maintain air pressure uniformity within the air film bearing 12 formed adjacent the surface of the plunger when the structure of FIG. 1 is assembled together as shown in FIG. 2. The carbon material comprising air distributors 6 and 7 also serves to center and lubricate the interface vis-axis the movable plunger in the event of accidental loss of air supply.

For the sake of simplicity and clarity of exposition, the three axis stepper motor controlled table carrying the repaired module, reservoir of epoxy passivating material and alcohol sponge station are not shown in the drawings. Such workpiece-holding positioning tables are well known in the art for positioning objects carried thereon, relative to a reference location, in accordance with 3-axis coordinates supplied to the respective stepper motor controllers. A separate stepper motor controller (not shown) also is provided to raise and lower probe sensor assembly 2 relative to the three axis controlled table in a manner well known to those skilled in the tool control art.

In operation, the table is indexed by x and y axis control signals to a position whereby the epoxy reservoir (not shown) is directly beneath the known location of probe 1. Then, the table is raised in accordance with a z axis control signal to allow the probe tip to be immersed in and pick up epoxy material. The table is lowered, after a predetermined tip immersion pause, and is indexed to the x-y coordinates of the substrate repaired site to be passivated. The probe stepper motor controller is actuated to lower the probe tip (carrying a globule of epoxy material) into contact with the repaired site whereupon the epoxy flows from the probe tip to cover the site. A signal from the transducer 4 at the moment of probe contact with the site stops the probe assembly stepper motor. The probe assembly is raised back to its stand-by position to permit the indexing of the table to the x-y coordinates of the next site to be passivated. The tip of the probe may be cleaned from time to time by providing a special cleaning cycle between site passivation cycles whereby the table may be indexed to the x-y coordinates of the alcohol sponge station.

The plunger comprising probe 1, member 5 and core 3 is suspended in neutral equilibrium, relative to transducer 4, by the previously described air film bearing 12 acting vertically as well as horizontally against member 5. Upon contact of probe 1 with a module repair site as the probe assembly 2 is lowered by its respective stepper motor control, the equilibrium position of core 3 of transducer 4 is disturbed causing the transducer 4 to generate a signal for stopping the stepper motor.

It should be noted that the epoxy or other material selected for passivation purposes must be of a nature compatible with the device repair site, i.e., the materials thereof and the environment (heat, chemicals and stress) it is subsequently exposed to. Additionally, the selected passivating material must have proper rheology, adherence and curing/drying characteristics. It has been found that the epoxy MINICO M 7000 available from MINICO Corp. of Congers, N.Y., is suitable for present applications.

While the invention has been described in terms of its preferred embodiments, those skilled in the art will realize that the invention can be practiced with modification within the spirit and scope of the appended claims.

Having thus described our invention, what we claim as new and desire to secure by Letters Patent is as follows:

1. An apparatus for dispensing a minute amount of liquid material onto a site of a substrate comprising:

a probe for dispensing liquid material, said probe having a tip;

a member;

a contact sensor connected to said probe by said member and movable with said probe relative to said site, said contact sensor having an equilibrium position;

a transducer having a core for receiving said contact sensor, said contact sensor being movable with respect to said transducer, said transducer producing a signal when said contact sensor is moved from its equilibrium position;

said contact sensor being moved from its equilibrium position upon said tip contacting said site, whereby said tip dispenses said liquid upon contacting said site.

2. The apparatus defined in claim 1 wherein said transducer is a differential transducer.

3. The apparatus defined in claim 1 wherein said transducer is a linear voltage differential transducer.

4. The apparatus defined in claim 1 wherein said probe together with said contact sensor are suspended on an air bearing adjacent to said member.

5. The apparatus defined in claim 4 and further comprising an upper and a lower porous carbon air distributor axially surrounding said member.

6. The apparatus defined in claim 1 wherein said probe together with said contact sensor are suspended on an air bearing adjacent to said member in neutral equilibrium which equilibrium is disturbed upon said tip contacting said site.

7. The apparatus defined in claim 1 wherein said probe tip is on the order of 30 microns in area.

8. The apparatus of claim 1 wherein said probe tip dispenses 0.1 to 1.0 nanoliters of said liquid material onto said site of said substrate.

* * * * *